United States Patent [19]

Storch

[11] 4,077,665

[45] Mar. 7, 1978

[54] PLASTIC RESTAURANT BOOTH SEAT

[75] Inventor: Adam Storch, Santa Ana, Calif.

[73] Assignee: International Installations, Los Angeles, Calif.

[21] Appl. No.: 679,232

[22] Filed: Apr. 22, 1976

[51] Int. Cl.[2] ..... A47C 15/00

[52] U.S. Cl. ..... 297/244; 297/DIG. 2; 297/457

[58] Field of Search ..... 297/244, 457, DIG. 2

[56] References Cited

U.S. PATENT DOCUMENTS

| | | | |
|---|---|---|---|
| 2,261,506 | 11/1941 | Scott | 297/244 |
| 2,400,167 | 5/1946 | Resnick | 297/244 X |
| 3,230,007 | 1/1966 | Spangler et al. | 297/457 X |
| 3,314,721 | 4/1967 | Smith | 297/DIG. 2 |
| 3,379,471 | 4/1968 | Dalziel | 297/244 X |
| 3,394,417 | 7/1968 | O'Link | 297/244 X |
| 3,527,498 | 9/1970 | Werner | 297/DIG. 2 |
| 3,669,495 | 6/1972 | Rudgisch | 297/DIG. 2 |
| 3,848,925 | 11/1974 | Harder, Jr. | 297/DIG. 2 |
| 3,919,370 | 11/1975 | Cotterell | 297/DIG. 2 |

*Primary Examiner*—Roy D. Frazier
*Assistant Examiner*—Peter A. Aschenbrenner
*Attorney, Agent, or Firm*—Spensley, Horn & Lubitz

[57] ABSTRACT

A restaurant booth seat having a unique shape and construction is disclosed. The seat has an exterior skin made of a hard plastic material and a substantially rigid plastic foam core. The seat comprises a back support member coupled to a separate base member. The base member is tapered from the front thereof towards the rear such that liquids, crumbs and the like are encouraged toward the rear of the base member. A grooved area extends into the base member along the width thereof adjacent the back support member such that the crumbs and liquids in the grooved area are rendered easily removable. By the use of the restaurant booth seat of the present invention, cleanup of such seat is made substantially easier than the seats of the prior art. Moreover, the booth seat of the present invention is durable yet provides the user with sufficient comfort.

8 Claims, 4 Drawing Figures

Fig. 3
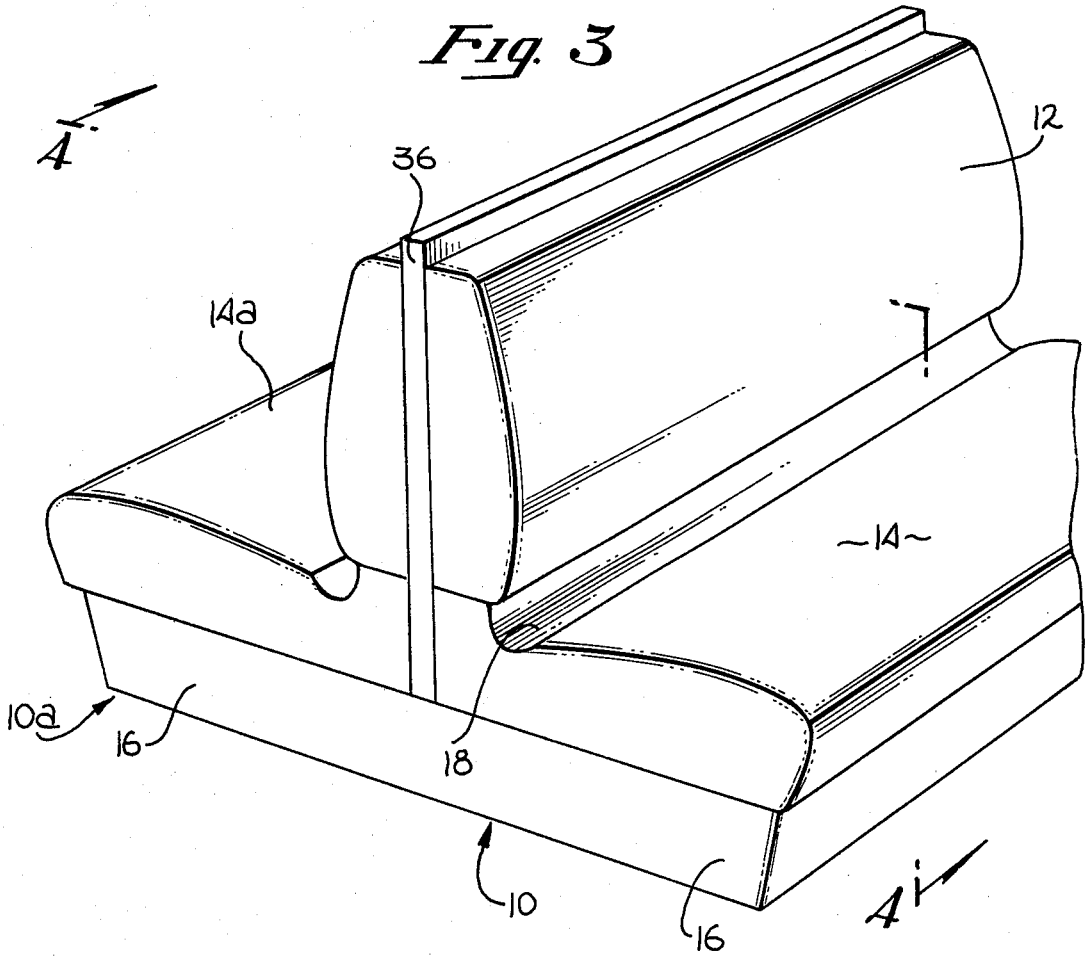
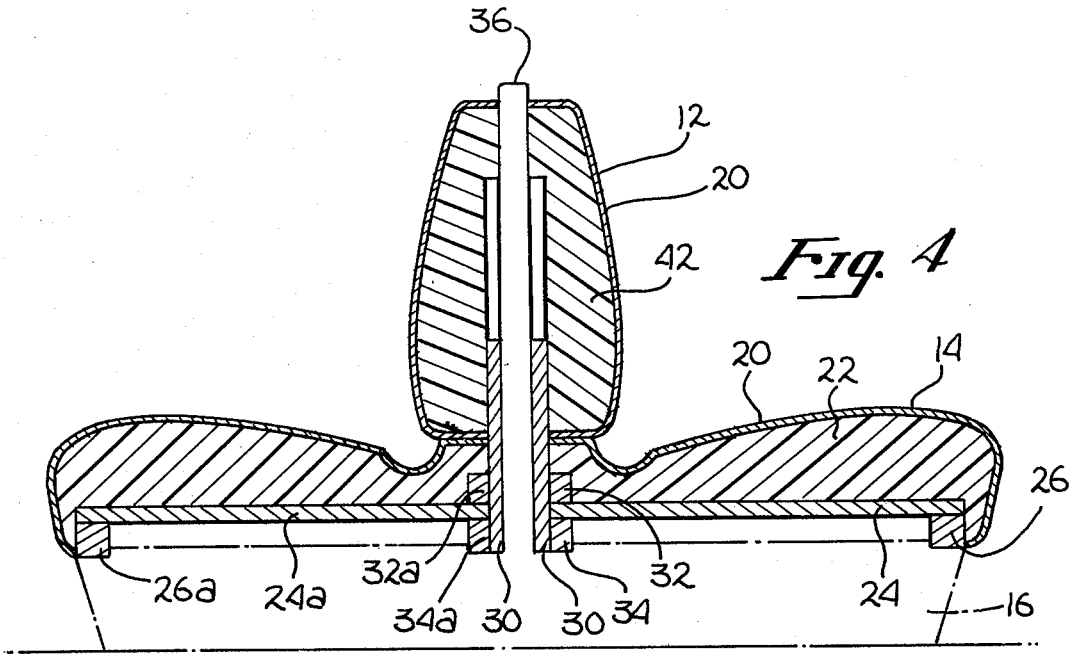
Fig. 4

PLASTIC RESTAURANT BOOTH SEAT

The present invention relates to seats, and more specifically, to plastic restaurant booth seats having unique construction.

BACKGROUND OF THE INVENTION

1. Field of the Invention

The present invention relates to restaurant booth seats, and more specifically, to a plastic restaurant booth seat having a unique construction.

2. Prior Art

The use of plastic materials in the construction of chairs and the like is well known. Such material has been found to be long lasting, relatively inexpensive, and provides the user with sufficient comfort. These factors have lead to the use of plastic in the construction of chairs having a wide variety of shapes and sizes. For example, Pershing (U.S. Pat. No. 3,833,259) discloses a vehicle seat which is comprised of three layers of different foams. The upper and lower layers are made of a polyurathane foam and the center layer is made up of a polyethelene foam. Such plastic foams are of a low density and produce a vehicle seat having a very flexible and "foamy" type feeling. These type of foams thus give the user a cushioned effect and have therefore found special utility in vehicles which are subject to intense vibrations. However, it is known that this type of flexible foam material does not stand up well to continued use and is especially vulnerable to abuse such as puncture, cutting and the like. While such flexible foams may be useful in vehicle construction, where rigidity would provide the user with an uncomfortable ride, manufacture of a chair from such materials, especially in a commercial setting, would not be acceptable because of the likelihood of damage.

Another prior art chair is disclosed by Shirakawa (U.S. Pat. No. 3,589,967). In Shirakawa, a chair is disclosed which has a cushioning material made of foam plastic and a covering material also made of plastic. As discussed hereinabove, the use of such cushioning material while providing the user with a great deal of comfort, tends to break down in a commercial setting where such chair would be subject to continuous and extensive use.

The problem of using flexible foam core seats with a flexible covering is recognized in the art. For example, in buses such flexible foam seats were originally used, but today most buses have switched to the use of fiber glass reinforced seats. These type of hard seats are not subject to cutting and the like; however, they too possess a number of shortcomings. One problem is that fiber reinforced seats are expensive to make and require complex machinery to achieve a smooth exterior surface. Moreover, such chairs are extremely hard and tend to be so uncomfortable that their use, especially in a restaurant is many times not acceptable.

The plastic chairs and seats of the prior art also possess another shortcoming. This relates to the specific design. For example, these chairs or seats if used in a restaurant setting would not prevent liquids and the like accidentally spilled from running off the chair and onto the floor. Such accidental spills and the like are a problem in a restaurant, not only from a health point of view (liquids on the floor attract flies and bugs), but also pose a potential problem in terms of patrons of the restaurant accidentally slipping on the liquids before clean-up can be effected. Finally, a chair or seat used in the restaurant must be capable of long periods of continued use and yet must still provide the user with sufficient comfort such that the meal can be eaten from a comfortable sitting position. However, the chair cannot be so comfortable so as to encourage the patrons to spend an undue amount of time in the booth seat, thereby preventing others from use of the same.

The present invention provides an answer to the above-identified problem associated with prior art chairs and seats, and contains none of the foregoing problems associated therewith. The booth seat of the present invention also has a unique shape which encourages liquids, crumbs and the like to proceed into an area from which they can be easily removed.

BRIEF SUMMARY OF THE INVENTION

The present invention relates to a restaurant booth seat and, more specifically, to a restaurant booth seat having a specific configuration which enables easy clean-up thereof and provides the user with a comfortable place to sit. The restaurant booth seat comprises a back support member having a rigid plastic exterior skin bonded to a substantially rigid foam core. A base member is coupled to the back support member and also has a rigid plastic exterior bonded to a substantially rigid foam core. The base member is shaped such that liquids and the like are encouraged towards the back support member and into a groove or trough member located adjacent said back support member. In this manner, liquids and the like are encouraged into the trough member where they are rendered easily removable therefrom.

Because a two-part booth seat is used, problems of construction and molding associated with prior art seats are eliminated. Moreover, because the chair is of a substantially rigid construction, it has a long life, but provides the user with a sufficient degree of comfort such that he can enjoy his meal.

The novel features which are believed to be characteristic of the invention, both as to its organization and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limits of the invention.

A BRIEF DESCRIPTION OF THE DRAWINGS

FIG. 3 is a perspective view showing two such booth seats joined in a back-to-back configuration.

FIG. 4 is a cross-sectional view of FIG. 3 taken along lines 4—4 and showing the internal construction of the back-to-back booth seat construction.

DESCRIPTION OF THE PREFERRED EMBODIMENT

Figure 1:
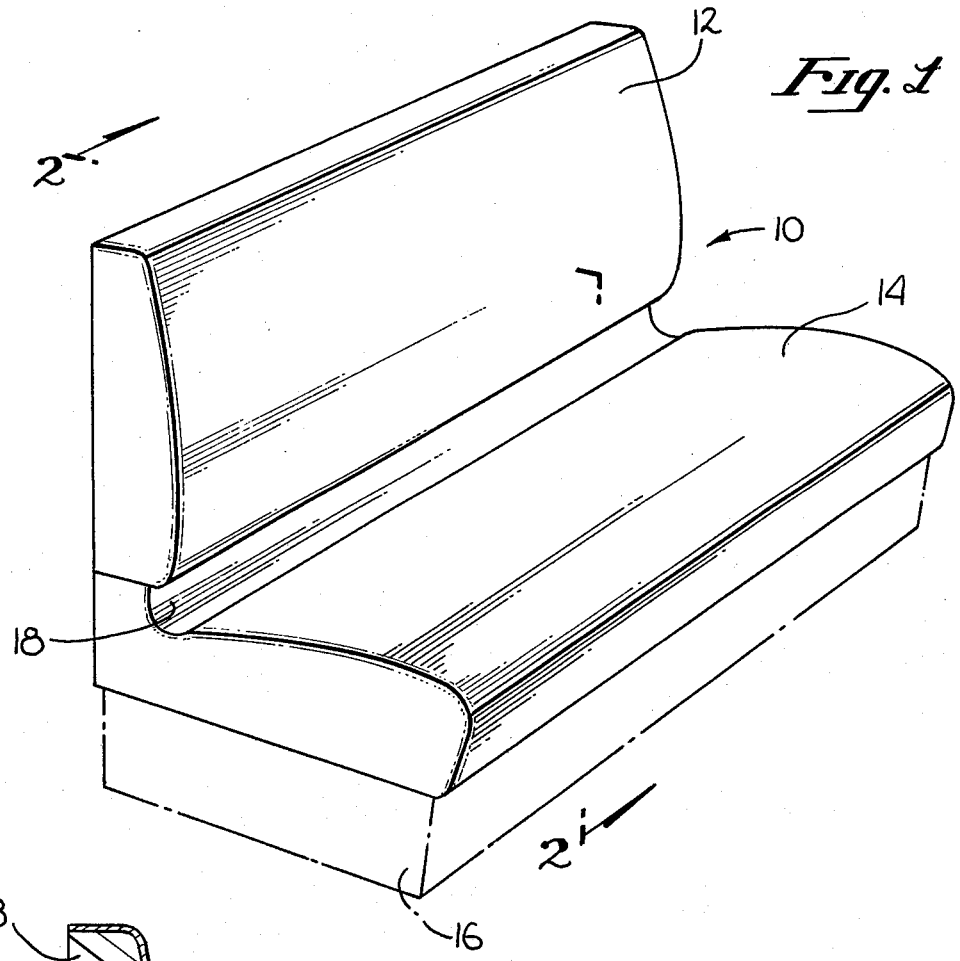
FIG. 1 is a perspective view showing the booth seat of the present invention.

Referring first to FIG. 1, there is shown, as a presently preferred embodiment, a booth seat 10 having a back member 12 and a base member 14. The base member 14 is disposed atop a base support 16 such that the base member 14 is raised up off the ground a predetermined distance. While a generally rectangular base support 16 is shown, other support members such as legs, and the like, are also within the scope of this invention. The base member 14 is shown in this Figure as being sloped or tapered from a larger front to a smaller back and terminating in a groove or trough area 18. Groove 18 represents a point of novelty of the present invention and a distinct advantage over the prior art. Such groove 18 enables easy clean-up as hereinafter described and prevents liquids, crumbs and the like from falling off the seat 10 onto the floor. It should also be noted in this Figure that the back 12 and the base member 14 are of a two-part construction which enables the seat 10 to be made without the problems associated with prior art seats.

Figure 2:
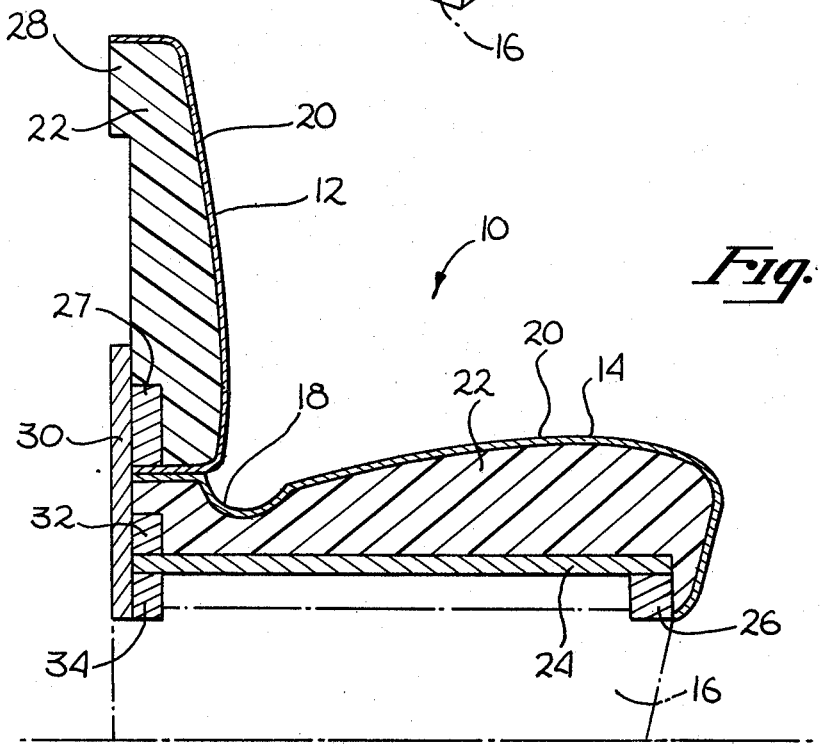
FIG. 2 is a cross-sectional view of FIG. 1 taken along lines 2—2 and showing the interior construction of the booth seat.

Referring now to FIG. 2, one can see that the back member 12 and the base member 14 are each comprised of a hard exterior skin and a hard foam interior. More specifically, back member 12 has a skin 20 and a foam core 22. Such materials are not a mere matter of choice and represent a distinction between the restaurant booth seat of the present invention and those of the prior art. In the present invention the skin 20 is made of acrylonitrile-butadiene-styrene (ABS). Such material has been found to be of sufficient stiffness and rigidity to prevent accidental breakthrough should objects be dropped on the seat 10. While other rigid plastics are within the scope of the present invention, ABS has been found to possess a combination of properties which makes it most suitable for use as the exterior skin of the seat 10.

The material used for the foam core 22 is also well known in the art and is preferably a urethane foam. However, while the prior art chairs have used the flexible urethane foam, the present invention uses a substantially rigid type foam which does not allow significant flexing of the back 12 of the seat 10. In the preferred embodiment, the urethane foam 22 has a density of from about 1–4 pounds per cubic foot; and most preferably, 4 pounds per cubic foot. The urethane foam is of a type that is sufficiently cross-linked such that it makes up a relatively inflexible core. The base member 14 is also comprised of a hard skin 20 and a rigid foam core 22 made of the same material as those discussed with reference to the back member 12. The same advantages are thus also associated with the base member 14; namely, long life and sufficient comfort.

As FIG. 2 also indicates, various wooden support members 24, 26, 28, 30, 32 and 34 are extended across the width of the seat 10 and enable the back 12 and the base 14 to be joined together as well as to provide extra support for the seat 10. Wood is used for these support members as it has been found to be sufficiently strong, but lightweight.

Referring now to FIG. 3, two of the seats described hereinabove have been joined in a back-to-back configuration. In this configuration, a first booth seat 10 is coupled to a second booth seat **10*a* adjacent the back thereof by means of a wooden joint member 36. The use of this back-to-back configuration eliminates the need for separate backings for each booth seat and in this manner ease of construction is achieved. More specifically, FIG. 4 points out that the support members 32 and 34 and 32*a* and 34*a*, respectively, of each of the seats 10 and 10*a*, are joined to joint member 36 using wood screw glue and the like. A substantially rectangular base 16 is positioned adjacent the bottom of the base member 14 such that support members 26 and 26*a* engage the base member and are secured therein. Thus, in this manner, one base enables two restaurant booth seats 10** to be joined in a back-to-back configuration without the need for providing a separate base or separate backing members for each seat.

The mode of construction of the restaurant booth seat 10 of the present invention will now be described. As a first step in the formation of the seat 10, the thermoformable skin 20 is placed in a vacuum mold formed to the desired shape. It has been found that ABS plastic is particularly useful inasmuch as it does not chip or peel and requires no "set up" as would be the case in the use of fiber glass and the like. In the preferred embodiment, the back member 12 and base member 14 are each made such that an easily removable shape is produced. The shape is such that the sides of the back member 12 and base member 14 are produced as continuous elements thus obviating the need for attaching separate sides so as to completely encase the foam core 22.

The respective members 12 and 14, after they are formed, are then placed in a female mold and the urethane-forming reactants are poured into the back cavity in each of the respective members. The wooden support members which have previously been joined together are inserted into the mold so as to proceed into the cavity a predetermined distance. More specifically, wooden support member 28 is positioned in back member 12 and support members 24, 26, 32 and 34 are positioned in the base member 14. The female molds are then covered and the urethane-forming ingredients are permitted to expand, thereby filling the back cavity in each of the members 12 and 14. After the urethane has been cured, and is now a rigid core 22, the back member 12 and base member 14 are taken out of their respective molds. It has been found that using the above procedure results in a bonding action between the skin 20 and the foam core 22. This enables the foam core 20 to be held against the skin 22 should someone sit on the chair, thereby providing sufficient support. It also obviates the need for using any glue, screw and the like to join the foam core 22 to the skin 20. The foam core 22 also bonds itself to the support members and thus no other support members are necessary thereby enabling the seat 10 to be easily disposed in an associated base without the need for other coupling members and the like. The only member needed to join the back member 12 to the base member 14 is support member 30 which is attached to support members 32 and 34 in the base member 14 and to member 27 in the back member 12. Thus, a basically complete unit is achieved which requires no further construction such as painting, bonding, etc.

After the seat 10 is fixed in position on the associated base 16, or should two such seats be joined together in a back-to-back configuration as shown in FIGS. 3 and 4, the seat 10 is ready for use. As discussed hereinabove, the base member 14 is sloped or tapered from a high point adjacent the front thereof towards the back member 12. Adjacent the area where the back member 12 and base member 14 are joined, there is a groove or trough 18 which extends along the width of the seat 10. Should liquids, crumbs and the like be spilled onto the seat onto the base 14, the natural tapering action will encourage the debris into the trough or groove member 18. It is then retained therein until it is removed. This has the distinct advantage of enabling easier clean-up in the restaurant in that substantially all spills onto the seat will not run to the floor; rather, they are retained in groove 18.

While the invention has been described in its preferred embodiments, it is to be understood that the words which have been used are words of description rather than of limitation and that changes within the purview of the appended claims may be made without departure from the true scope and spirit of the invention in its broader aspects.

I claim:

1. A restaurant booth seat configured to be easily assembled comprising, two separate basic elements, each of said elements having an exterior occupant supporting skin of hard rigid plastic material and a substantially rigid plastic foam core, said elements being (i) a back support member selectively secured to (ii) a base member; said base member having an upper surface tapered from the front thereof toward the rear such that liquids, crumbs and the like are encouraged toward the rear of said base member, said seat further having a grooved area formed in said base member covered by said exterior skin and extending along the width of said base member adjacent said back support member whereby crumbs, liquid and the like in said grooved area are rendered easily removable, said back support member and said base member each having a plurality of support members integrally formed within said foam core such that said back support member and said base member can be selectively joined together in a secure manner.

2. The booth seat as defined in claim 1 wherein said seat is comprised of separate and interconnected back member and base member.

3. The booth seat as defined in claim 1 wherein said rigid foam core is bonded to said exterior skin.

4. The booth seat as defined in claim 1 wherein said base member and said back support member are disposed on wooden supports.

5. The booth seat as defined in claim 1 wherein two said booth seats are joined in a back-to-back configuration.

6. A two part restaurant booth seat comprising (a) a back support member having a hard, rigid plastic exterior occupant supporting skin bonded to a substantially rigid foam core;

(b) a base member coupled to said back support member, said base member having a hard, rigid plastic exterior occupant supporting skin bonded to a substantially rigid foam core, said base member having an upper surface shaped such that liquids and the like are encouraged toward the said back support member said base member forming a trough member covered by said exterior skin located adjacent said back support member whereby crumbs and the like in said trough are rendered easily removable, said back support member and said base member each have a plurality of support members integrally formed within said foam core such that said back support member and said base member can be selectively joined together in a secure manner.

7. The booth seat as defined in claim 6 wherein said skin is acrylonitrile-butadiene-styrene and said foam core is urethane foam.

8. The booth seat as defined in claim 6 wherein a support member extends up from said base member and couples said base member to said back member.

* * * * *